US006747223B2

(12) United States Patent
Hattori

(10) Patent No.: US 6,747,223 B2
(45) Date of Patent: Jun. 8, 2004

(54) WATERPROOF SWITCH DEVICE

(75) Inventor: Takeshi Hattori, Tokyo (JP)

(73) Assignee: NEC Corporation, Tokyo (JP)

( * ) Notice: Subject to any disclaimer, the term of this patent is extended or adjusted under 35 U.S.C. 154(b) by 207 days.

(21) Appl. No.: 09/884,076

(22) Filed: Jun. 20, 2001

(65) Prior Publication Data

US 2001/0054547 A1 Dec. 27, 2001

(30) Foreign Application Priority Data

Jun. 21, 2000 (JP) ..... 2000/186038

(51) Int. Cl.[7] ..... H01H 9/04

(52) U.S. Cl. ..... 200/302.1; 200/235; 200/335; 200/407; 200/412; 200/441

(58) Field of Search ..... 200/302.1, 235, 200/407, 412, 335, 441

(56) References Cited

U.S. PATENT DOCUMENTS 4,386,253 A * 5/1983 Neuser ..... 200/302.1
4,943,696 A * 7/1990 Staples ..... 200/407
5,668,357 A * 9/1997 Takiguchi et al. ..... 200/5 R

FOREIGN PATENT DOCUMENTS

| | | |
|---|---|---|
| JP | 57-50042 | 3/1982 |
| JP | 04-15878 | 2/1992 |
| JP | 04-47860 | 11/1992 |
| JP | 09-164602 | 6/1997 |
| JP | 09-315710 | 12/1997 |
| JP | 11-119886 | 4/1999 |

* cited by examiner

*Primary Examiner*—Elvin Enad
*Assistant Examiner*—Jennifer A Poker
(74) *Attorney, Agent, or Firm*—Sughrue Mion, PLLC

(57) ABSTRACT

A switch device includes (a) a switch arranged on a bottom of a recess, and (b) a waterproof sheet adhered at its outer edge to a wall defining the recess, at a certain height to entirely cover the recess therewith. The waterproof sheet has a first area greater than a cross-sectional area of the recess when the waterproof sheet is in its original planar form. A difference between the first area of the waterproof sheet and the cross-sectional area of the recess allows the switch to be actuated through the waterproof sheet, and disallows moisture to enter the recess through the waterproof sheet. The waterproof sheet is composed of transparent or semi-transparent resin, for instance. The waterproof sheet may be adhered at its outer edge to a summit or a bottom of the wall.

15 Claims, 5 Drawing Sheets

WATERPROOF SWITCH DEVICE

BACKGROUND OF THE INVENTION

1. Field of the Invention

The invention relates to waterproof switch device.

2. Description of the Related Art

An operator often makes contact with a switch in an electronic or electric device with his/her wet hand. For instance, a switch of an elevator is often contacted by an operator's wet hand. As an alternative, a switch in an electronic or electric device may be wet in rain in dependence on a circumstance where the switch is used. Hence, a switch with which water or moisture may make contact is usually designed to have a waterproof structure in order to protect internal electronic or electric parts from water or moisture.

FIG. 1 is an exploded perspective view of a switch device used for an elevator, suggested in Japanese Unexamined Patent Publication No. 9-315710.

The illustrated switch device is comprised of a plate 101 on which indicators 102 indicative of stories of a building are formed, a pair of push buttons 103 indicative of up or down and formed below the indicators 102, protection covers 106 on each of which transparent protection filter 105 is adhered, and gap fillers 107.

The protection covers 106 are fixedly adhered at their outer edges to the plate 101 through an adhesive around the push buttons 103. Both of the transparent protection filters 105 and the protection covers 106 are composed of waterproof material. The gap fillers 107 each comprised of a transparent plate 107*a* are sandwiched between the push buttons 103 and the transparent protection filters 105.

FIG. 2 is a cross-sectional view of the switch device illustrated in FIG. 1.

The plate 101 is formed with a recess, in which the push buttons 103 are located. Rectangular frames 111 are adhered to the plate 101 so that each of the frames 111 surrounds each of the push buttons 103. The frames 111 prevent the push buttons 103 from upwardly deviating.

A frame 112, which is a part of the protection cover 106, is fixedly adhered at its bottom to the plate 101 through an adhesive such that the frame 112 surrounds the rectangular frame 111. The transparent protection filter 105 is fixedly adhered to and covers the frame 112 therewith through an adhesive 114.

The transparent protection filter 105 is comprised of a flexible sheet, and hence, even if an operator pushes the push button 103 through the transparent protection filter 105, the push button 103 could not be sufficiently actuated. Hence, the transparent gap filler 107 is arranged between the push button 103 and the transparent protection filter 105. Specifically, as illustrated in FIG. 2, the transparent gap filler 107 is adhered at its bottom surface to the push button 103 through an adhesive such that an operator could push the push button 103, if he/she slightly pushes the transparent protection filter 105.

Japanese Unexamined Utility Model No. 4-15878 has suggested a switch device having a structure similar to the structure of the switch device illustrated in FIGS. 1 and 2. The suggested switch device has the same structure as that of the switch illustrated in FIGS. 1 and 2 except the gap filler 107. In the suggested switch device, a transparent or semi-transparent film covers a keyboard therewith. Since a gap between the keyboard and the transparent or semi-transparent film is quite small, it is not necessary to arrange a gap filler between the keyboard and the transparent or semi-transparent film.

FIG. 3 illustrates another conventional switch device.

The illustrated switch device is comprised of a main body 121, a first cover 123 detachably fixed to the main body 121 through bolts 126, switches 122 arranged on a bottom of a recess formed at a surface of the main body 121, and a second cover 124 covering the recess therewith and detachably fixed to the main body 121.

The illustrated switch is used in a waterproof electronic device. The switch illustrated in FIG. 3 is different from the switch illustrated in FIGS. 1 and 2 in that the switch illustrated in FIG. 3 is only sometimes used, whereas the switch illustrated in FIGS. 1 and 2 is frequently used. Hence, the second cover 124 is taken out of the first cover 123, only when the switches 122 are actuated.

The first cover 123 is fixed to the main body 121 through a packing (not illustrated) by means of the bolts 126. As illustrated in FIG. 4, a packing 127 in the form of a rectangular frame is adhered to a lower surface of the second cover 124. Since the switches 122 are located below a surface 128 of the main body 121, when the second cover 124 is fixed to the surface 128 of the main body 121 by inserting bolts 129 into associated threaded holes 131, the packing 127 is compressed onto the surface 128 of the main body 121, ensuring that the switches 122 are kept waterproof.

In the switch device illustrated in FIGS. 1 and 2 where a waterproof sheet such as the transparent protection filter 105 is located above the push button 103, an operator deforms the transparent protection filter 105 to thereby actuate the push button 103 through the gap filler 107. Accordingly, if the push button 103 is necessary to be actuated to a high degree, the switch device illustrated in FIGS. 1 and 2 is not suitable for actuating the push button 103.

For instance, if a switch comprised of a toggle switch which turns on or off a contact in accordance with an angle in which a lever is inclined is to be actuated through a sheet such as the transparent protection filter 105, it is quite difficult to exactly actuate the toggle switch, because the transparent protection filter 105 is not flexible. If the toggle switch is forced to be actuated through the transparent protection filter 105, the filter 105 might be broken.

In contrast, the switches 122 are actuated directly by an operator after the second cover 124 is taken off, in the switch device illustrated in FIGS. 3 and 4. Accordingly, if the switches 122 have to be actuated to a high degree, it would be possible to do so, because an operator can directly actuate the switches 122 with his/her fingers.

However, the second cover 124 has to be taken off before actuating the switches 122, in the switch device illustrated in FIGS. 3 and 4. Hence, the second cover 124 has to be fixed again to the surface 128 of the main body 121 after actuating the switches 122. If an operator inappropriately fixes the second cover 124 to the surface 128 or forgets doing so, the switches 122 are not kept waterproof. In addition, the switches 122 are not kept waterproof also due to degradation or falling of the packing 127, inappropriate setting of the packing 127 when a packing 127 is exchanged to a new one, and/or insufficient fastening of the bolts 129.

Japanese Unexamined Patent Publication No. 57-50042 has suggested a switch device comprising a key switch slightly projecting through a window of a front panel, and a flexible transparent dust-proof mask. The dust-proof mask is detachably adhered to a lower surface of the front panel.

Japanese Utility Model Publication No. 4-47860 has suggested a push button switch device comprised of an electrically insulating base formed with a recess, a plurality of fixed contacts being arranged on a bottom of the recess, an electrically conductive movable projection which is accommodated in the recess and which is elastically deformable, a push button having a polygonal flange projecting from an outer surface thereof, and centrally pushing the movable projection to turn on or off the fixed contacts, a planar cover having a polygonal inner surface along which the polygonal flange is slidably guided, and being engaged to an inner edge of a through-hole of the push button for preventing the push button from falling, and an elastic sheet which hermetically seals the recess and which is sandwiched at its outer edge between the cover and the base.

Japanese Unexamined Patent Publication No. 9-164602 has suggested a waterproof case in which a display unit and a push button are accommodated. The waterproof case is comprised of a hard transparent case which covers the display unit and an area around the push button therewith and is formed with an opening in alignment with the push button, an elastic colored cover which makes close contact with the hard transparent case except the display unit, and which is softer than the hard transparent case, and a part which makes close contact with a surface of the cover, has the same hardness as that of the cover or is softer than the cover, and is elastically carried at the cover.

Japanese Unexamined Patent Publication No. 11-119886 has suggested a remote control keyboard comprised of a slide switch formed on a circuit board, and a panel formed with a window through which a slide knob projecting upwardly from the slide switch is exposed. The slide knob is designed to have an upper end located lower than the panel. The window is covered with a flexible, semi-transparent waterproof and dust-proof sheet.

The above-mentioned problems remain unsolved even in the above-mentioned Publications.

SUMMARY OF THE INVENTION

In view of the above-mentioned problems in the conventional switch devices, it is an object of the present invention to provide a switch device which is capable of readily actuating a switch and keeping the switch waterproof, and which is not always necessary to have a waterproof cover.

The present invention provides a switch device including (a) a switch arranged on a bottom of a recess, and (b) a waterproof sheet adhered at its outer edge to a wall defining the recess, at a certain height to entirely cover the recess therewith, the waterproof sheet having a first area greater than a cross-sectional area of the recess when the waterproof sheet is in its original planar form, a difference between the first area of the waterproof sheet and the cross-sectional area of the recess, allowing the switch to be actuated through the waterproof sheet and disallowing moisture to enter the recess through the waterproof sheet.

In the switch device in accordance with the present invention, a switch arranged on a bottom of a recess is actuated through a waterproof sheet. This ensures that the switch is kept waterproof. The waterproof sheet is designed to have an area greater than a cross-sectional area of the recess when the waterproof sheet is in its original planar form. Hence, a difference between the area of the waterproof sheet and the cross-sectional area of the recess would make it possible to actuate the switch from outside of the waterproof sheet.

In order to ensure such a difference between the area of the waterproof sheet and the cross-sectional area of the recess, the first area of the waterproof may be designed to be greater than the cross-sectional area of the recess even when no tensile force is applied to the waterproof sheet, in which case, the waterproof sheet is not necessary to have flexibility.

As an alternative, in order to ensure the above-mentioned difference, the first area of the waterproof may be designed to be greater than the cross-sectional area of the recess only when a tensile force is applied to the waterproof sheet, in which case, the waterproof sheet is necessary to have flexibility.

For instance, the waterproof sheet may be composed of transparent or semi-transparent resin.

For instance, the waterproof sheet is adhered at its outer edge to a summit of the wall.

This ensures that the waterproof sheet can be readily adhered to the wall, and that the recess has a shallow depth.

For instance, the waterproof sheet is adhered at its outer edge to a bottom of the wall.

This ensures that even when the waterproof sheet has a size greater than a size of the recess, the waterproof sheet does not project beyond the recess. Hence, the cover could be readily adhered to a summit of the wall.

The switch device may further include a cover detachably covering the recess therewith.

This ensures that the waterproof sheet can be protected with the cover covering the waterproof sheet therewith, and hence, it would be possible to lengthen a lifetime of the waterproof sheet.

It is preferable that the waterproof sheet is comprised of a flexible portion and a light-permeable portion, in which case, the light-permeable portion may be positioned in alignment with the switch.

It is preferable that the waterproof sheet is comprised of a flexible portion and an expandable portion, in which case, the expandable portion may be in the form of bellows.

For instance, a pattern indicative of where the switch is located may be printed on the waterproof sheet.

This ensures that even if the waterproof sheet is composed of light-impermeable material, an operator could readily and exactly actuate the switch.

It is preferable that the switch device further includes an indicator indicative of whether the switch is turned on or off.

This ensures that an operator could readily confirm whether the switch is appropriately actuated or not.

The advantages obtained by the aforementioned present invention will be described hereinbelow.

In accordance with the present invention, a switch arranged on a bottom of a recess is actuated by an operator through the waterproof sheet. This ensures that the switch is kept waterproof. In addition, since the waterproof sheet acts as a dust-proof sheet, it would be possible to prevent dust from entering the recess, ensuring enhancement in reliability of the switch.

Furthermore, it would be readily checked as to whether a switch was exchanged to a new one by inspecting whether the waterproof sheet is damaged or not.

If an operator inappropriately sets or forgets setting an additional protection cover, the waterproof sheet would keep the switch waterproof.

In addition, since the waterproof sheet is designed to be expandable or movable in the recess, it would be possible to adjust a difference in a pressure between inside and outside the recess with the switch being kept waterproof and/or dust-proof.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

Figure 1:
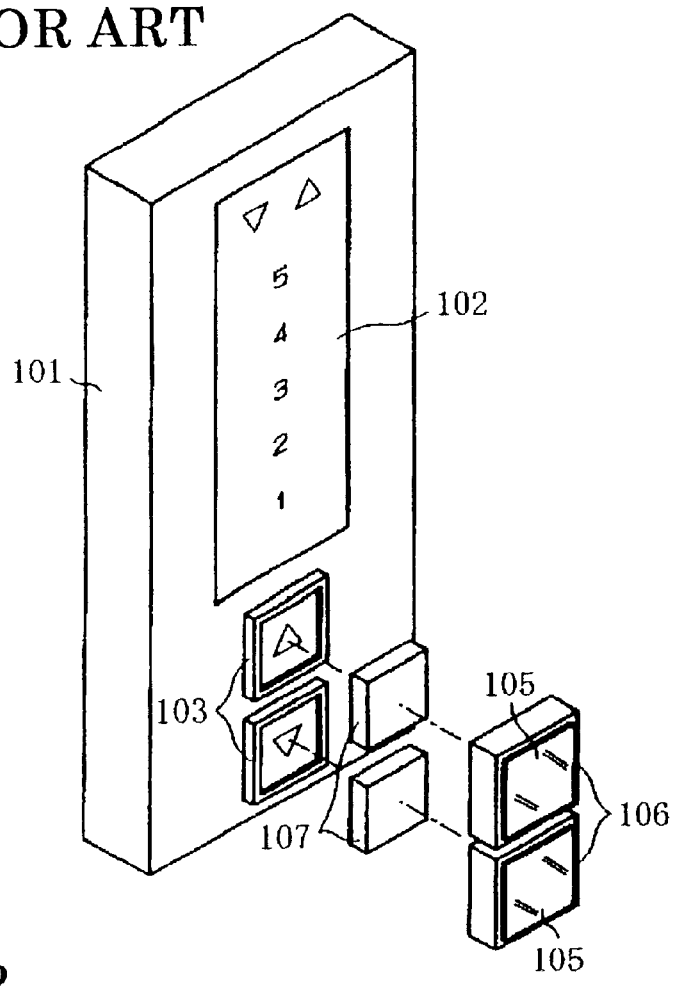
FIG.1 PRIOR ART
FIG. 1 is an exploded perspective view of a conventional switch device used for an elevator.
Figure 2:
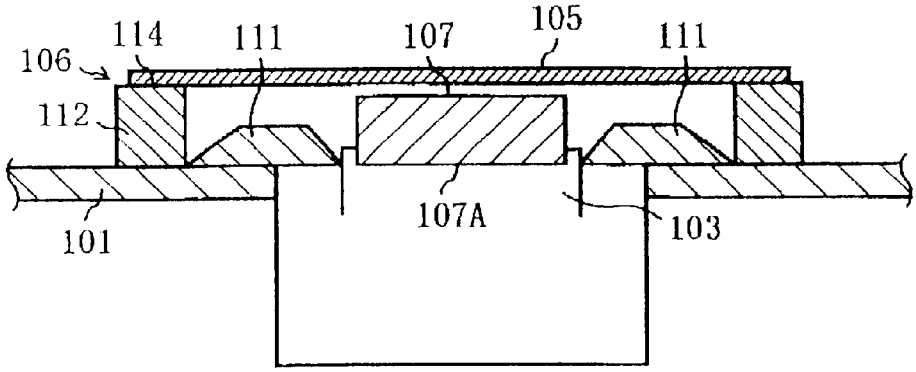
FIG.2 PRIOR ART
FIG. 2 is a cross-sectional view of the switch device illustrated in FIG. 1.
Figure 3:
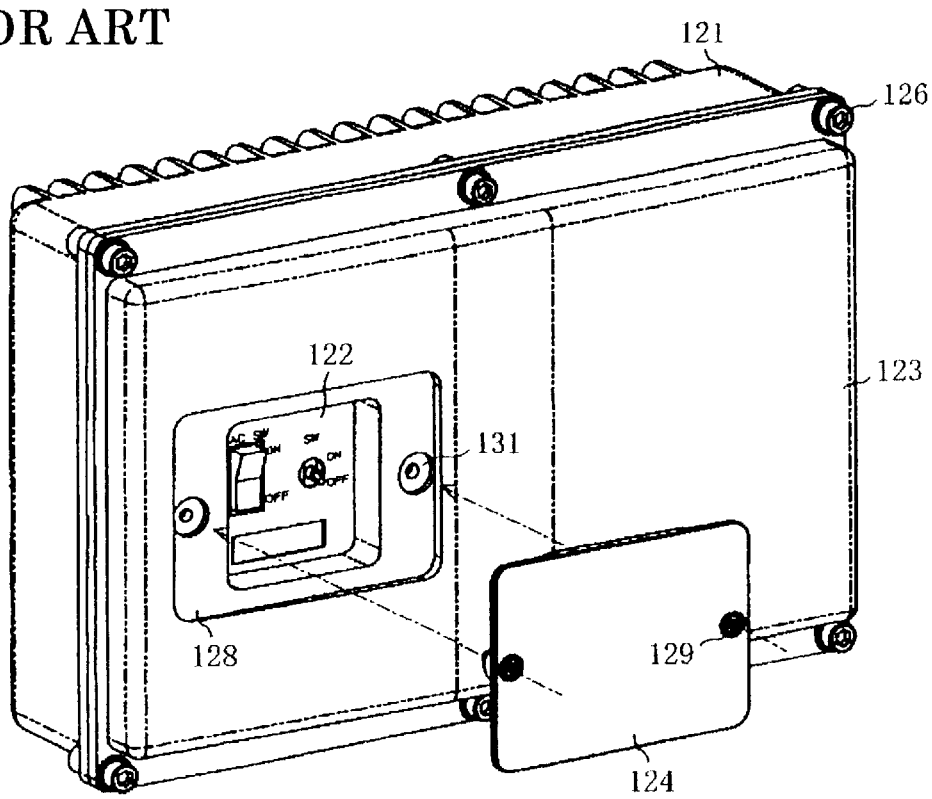
FIG.3 PRIOR ART
FIG. 3 is a perspective view of another conventional switch device.
Figure 4:
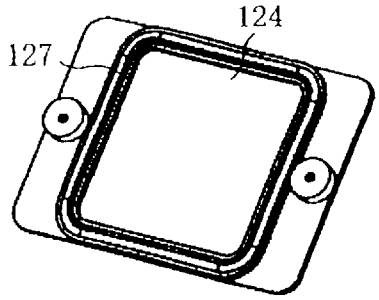
FIG.4 PRIOR ART
FIG. 4 is a perspective view of a second cover which is a part of the switch device illustrated in FIG. 3.
Figure 5:
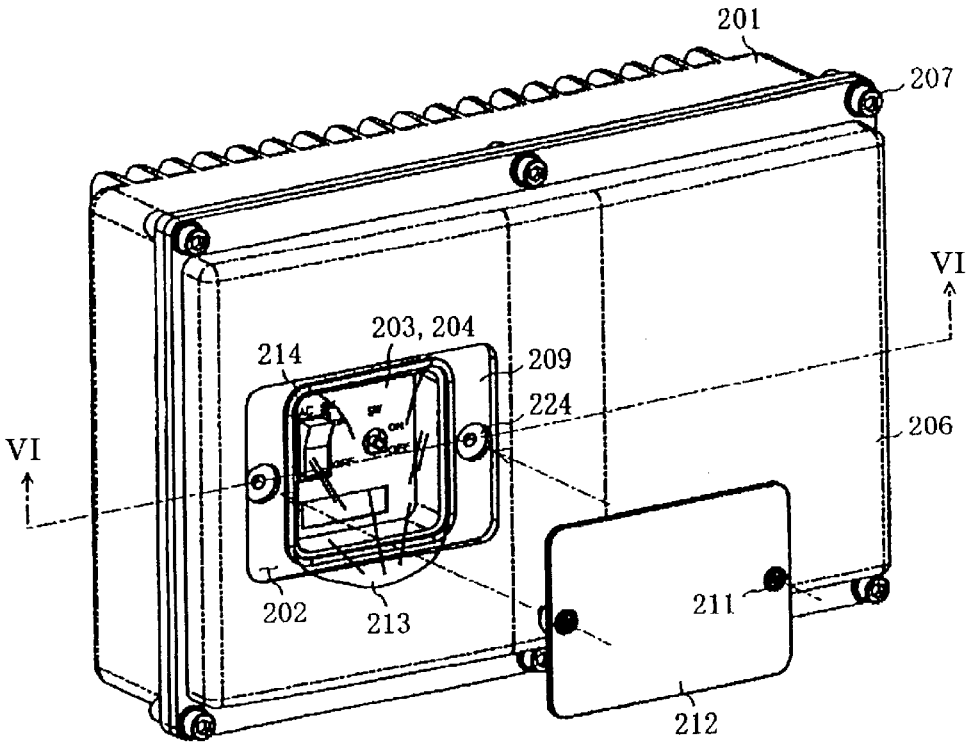
FIG. 5 is a perspective view of a switch device in accordance with the first embodiment of the present invention.

FIG. 5 is a perspective view of a switch device in accordance with the first embodiment of the present invention.

The switch device in accordance with the first embodiment is comprised of a main body 201 formed at a surface 202 thereof with a recess 203, switches 204 arranged on a bottom of the recess 203, a first cover 206 fastened to the main body 201 by means of bolts 207 with a packing (not illustrated) being sandwiched therebetween, and formed with a rectangular window 209 through which the switches 204 are exposed, a transparent waterproof sheet 213 covering the recess 203 therewith, and a second cover 212 detachably fixed to the main body 201 in the rectangular window 209 by means of bolts 211, switches 122.

The second cover 212 protects the switches 204 from external impacts. When an operator actuates the switches 204, the second cover 212 is taken off.

The transparent waterproof sheet 213 is adhered at its outer edge through an adhesive 214 to a summit of a wall defining the recess 203 such that the recess 203 is hermetically sealed by the waterproof sheet 213. The waterproof sheet 213 is designed to have an area greater than a cross-sectional area of the recess 203 by a predetermined percent in the range of 15% to 50%.

The waterproof sheet 213 in the first embodiment is comprised of silicone rubber having a thickness of 1 mm, and has an expansion rate of 50%. Silicone rubber has superior durability and flexibility, and an exposure test shows that silicone rubber has a duration of 10 years until physical characteristics such as an expansion rate become half of initial physical characteristics. In the first embodiment, since the waterproof sheet 213 is protected by the first cover 206 and the second cover 212, the waterproof sheet 213 could have a lengthened lifetime.

The waterproof sheet 213 may be composed of other materials. For instance, the waterproof sheet 213 may be composed of chloroprene rubber having an expansion rate of about 40%. Silicone rubber and chloroprene rubber are advantageous in that they can make a transparent sheet.

Figure 6:
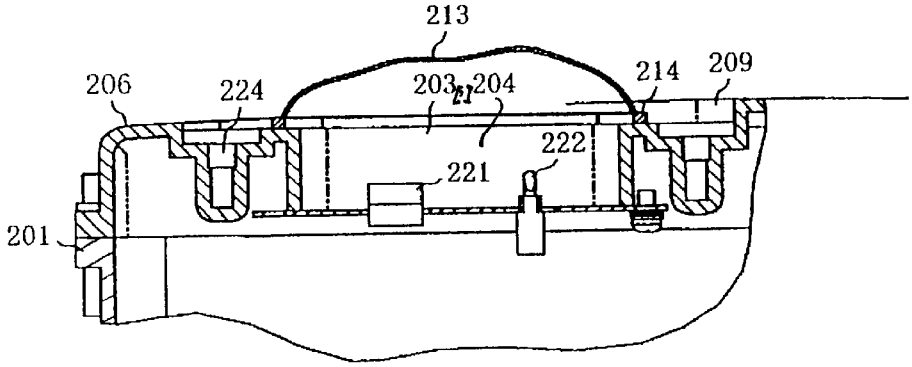
FIG. 6 is a partial cross-sectional view taken along the line VI—VI in FIG. 5.

FIG. 6 is a partial cross-sectional view taken along the line VI—VI in FIG. 5.

As illustrated in FIG. 6, the switches 204 are comprised of a seesaw switch 221 for turning a power source on or off, and a toggle switch 222 for turning a specific device on or off.

The waterproof sheet 213 having an area greater than a cross-sectional area of the recess 203 is adhered at its outer edge to a summit of a wall defining the recess 203, through the adhesive 214. The waterproof sheet 213 is transparent, but may be semi-transparent. The waterproof sheet 213 may be composed of expandable and shrinkable material.

Since the waterproof sheet 213 is designed to have a size greater than a size of the recess 203, an operator could readily actuate the switches 204 by compressing the waterproof sheet 213 towards the recess 203.

If the waterproof sheet 213 has a low transparency or is opaque, drawings and/or description indicative of a location of the switches 204 and/or a method of actuating the switches 204 may be printed on a surface of waterproof sheet 213. Such drawings and/or description would assist an operator to confirm where the switches 204 are located, and surely actuate the switches 204.

An indicator such as a lamp may be arranged in the recess 203 together with the switches 204 in order for an operator to confirm whether the switches 204 are surely actuated. Such an indicator may be positioned in a waterproof condition in the vicinity of threaded holes 224 to which the bolts 211 are inserted for fastening the second cover 212 to the main body 201.

Figure 7:
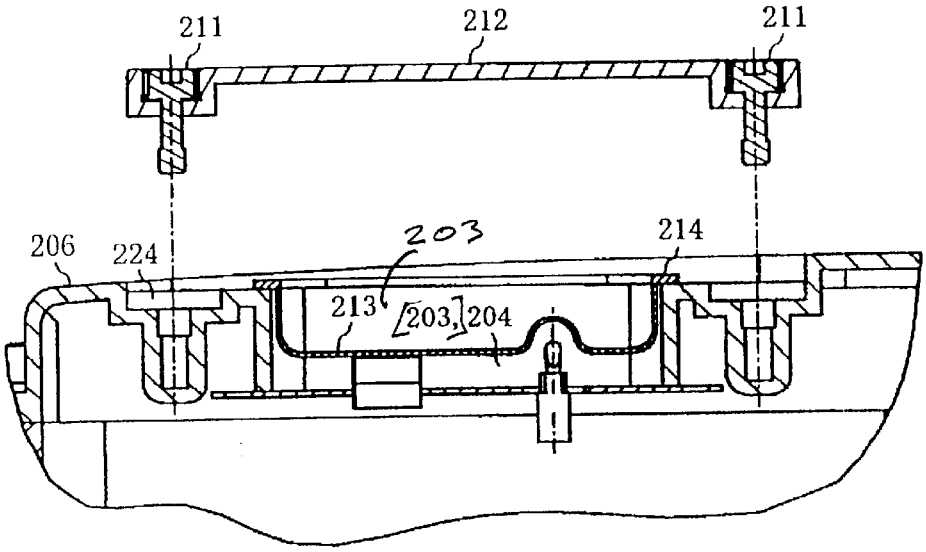
FIG. 7 is a partial cross-sectional view taken along the line VI—VI in FIG. 5 when a cover is fastened to a main body.

FIG. 7 illustrates the second cover 212 to be fastened to the main body 201.

The bolts 211 are in advance fastened to the second cover 212, and are to be inserted into threaded holes 224 of the main body 201. Before fastening the second cover 212 to the main body 201, the waterproof sheet 213 is forced to be accommodated in the recess 203. Thus, the waterproof sheet 213 would not be a bar for fastening the second cover 212 to the main body 201.

If the waterproof sheet 213 is composed of flexible material, the waterproof sheet 213 would not project over the recess 203, and hence, it would not be necessary to force the waterproof sheet 213 into the recess 203 when the second cover 212 is fastened to the main body 201.

Figure 8:
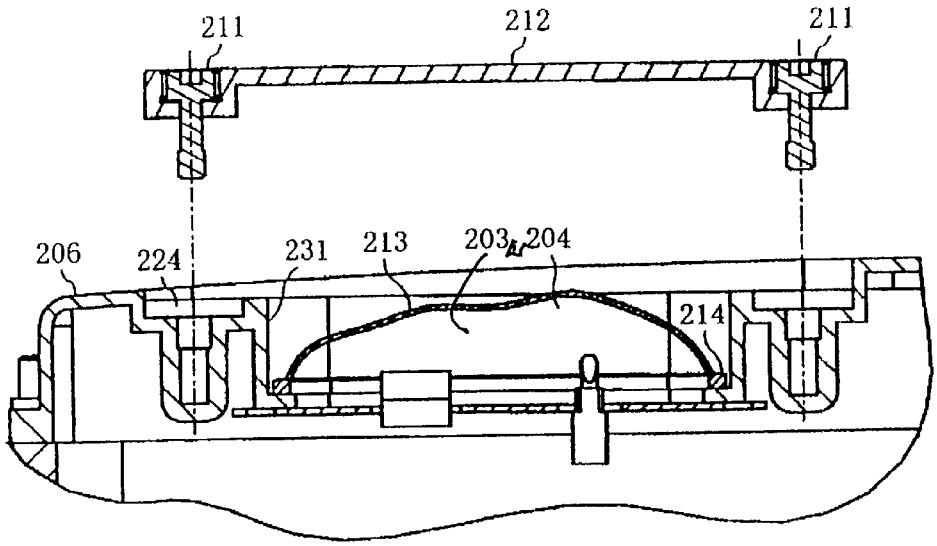
FIG. 8 is a partial cross-sectional view of a switch device in accordance with the second embodiment of the present invention, taken along the line VI—VI in FIG. 5.

FIG. 8 illustrates a switch device in accordance with the second embodiment of the present invention. Parts or elements that correspond to those of the first embodiment illustrated in FIGS. 5–7 have been provided with the same reference numerals.

In the above-mentioned first embodiment, the waterproof sheet 213 is adhered at its outer edge to a summit of a wall 231 defining the waterproof sheet 213. In contrast, in the second embodiment, the waterproof sheet 213 is adhered at its outer edge to a bottom of the wall 231 defining the waterproof sheet 213. The switch device in accordance with the second embodiment has the same structure as that of the switch device in accordance with the first embodiment except the above-mentioned difference.

By determining a position at which the waterproof sheet 213 is adhered to the wall 231 or determining a height of the wall 231 such that the deformed waterproof sheet 213 has a summit being level with or lower than a height of the wall 231, the second cover 212 could be fastened to the main body 201 without the waterproof sheet 213 being caught between the main body 201 and the second cover 212.

Figure 9:
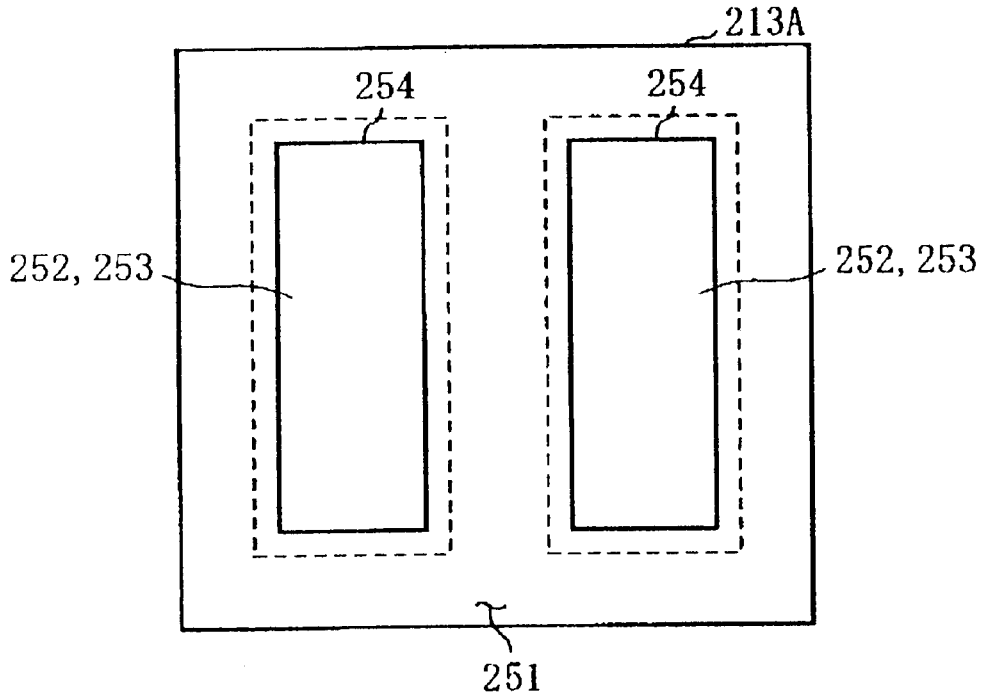
FIG. 9 is a top plan view of the waterproof sheet used in a switch in accordance with the third embodiment.

FIG. 9 illustrates a waterproof sheet 213A to be used in a switch device in accordance with the third embodiment.

The waterproof sheet 213A in the third embodiment is designed to have the same area as a cross-sectional area of the recess 203. The waterproof sheet 213A is comprised of a stretchable sheet 251 composed of stretchable material such as rubber, and formed with a plurality of windows 252, and transparent resin sheets 253 adhered at their outer edges to the stretchable sheet 251 such that the transparent resin sheets 253 covers the windows 252 therewith.

The windows 252 are positioned in alignment with the switches 204 arranged on a bottom of the recess 203.

Since the waterproof sheet 213A is comprised of a combination of the stretchable sheet 251 and the transparent resin sheets 253, the waterproof sheet 213A has high flexibility, and it would be possible to deform the transparent resin sheets 253 to the switches 204. Accordingly, an operator could readily actuate the switches 204 through the waterproof sheet 213A.

In addition, since the waterproof sheet 213A is designed to have the same area as a cross-sectional area of the recess 203, the waterproof sheet 213A would not interfere with the second cover 212 to be fastened to the main body 201.

Figure 10:
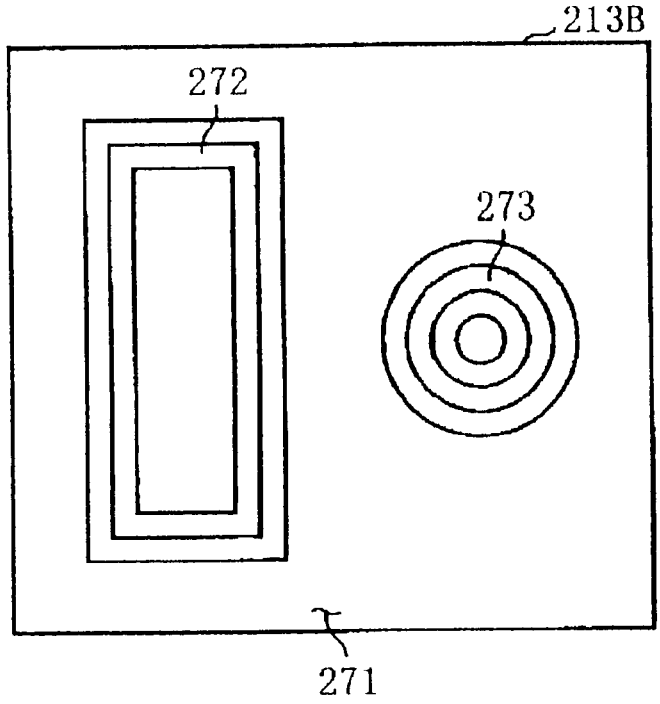
FIG. 10 is a top plan view of the waterproof sheet used in a switch in accordance with the fourth embodiment.

FIG. 10 illustrates a waterproof sheet 213B to be used in a switch device in accordance with the fourth embodiment.

The waterproof sheet 213B in the fourth embodiment is designed to have the same area as a cross-sectional area of the recess 203. The waterproof sheet 213B is comprised of a stretchable sheet 271, and is designed to have stretchable and shrinkable areas 272 and 273 located in alignment with the switches 204. The stretchable and shrinkable areas 272 and 273 are in the form of bellows.

The waterproof sheet 213B illustrated in FIG. 10 is used for a switch device comprised of the seesaw switch 221 and the toggle switch 222 both illustrated in FIG. 6. Hence, the stretchable and shrinkable area 272 associated with the seesaw switch 221 is designed to be in the form of a rectangular frame, and the stretchable and shrinkable area 273 associated with the toggle switch 222 is designed to be in the form of a ring. The stretchable and shrinkable area 273 associated with the toggle switch 222 may be designed to be in the form of an ellipse having a major axis extending in a direction in which the toggle switch 222 moves.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2000-186038 filed on Jun. 21, 2000 including specification, claims, drawings and summary is incorporated herein by reference in its entirety.

What is claimed is:

1. A switch device comprising:

(a) a switch arranged on a bottom of a recess; and (b) a waterproof sheet adhered at its outer edge to a wall defining said recess, at a certain height to entirely cover said recess therewith, said waterproof sheet having a non-stretched portion that is positionable in said recess, said non-stretched portion having an area greater than a cross-sectional area of said recess, a difference between said area of said waterproof sheet and said cross-sectional area of said recess, allowing said switch to be actuated through said waterproof sheet and disallowing moisture to enter said recess through said waterproof sheet.

2. The switch device as set forth in claim 1, wherein said waterproof sheet is composed of transparent or semi-transparent resin.

3. The switch device as set forth in claim 1, wherein said waterproof sheet is adhered at its outer edge to a summit of said wall.

4. The switch device as set forth in claim 1, wherein said waterproof sheet is adhered at its outer edge to a bottom of said wall.

5. The switch device as set forth in claim 1, wherein said area of said waterproof sheet is greater than said cross-sectional area of said recess even when no tensile force is applied to said waterproof sheet.

6. The switch device as set forth in claim 1, further comprising a cover detachably covering said recess therewith.

7. The switch device as set forth in claim 1, wherein said waterproof sheet is comprised of a flexible portion and a light-permeable portion.

8. The switch device as set forth in claim 7, wherein said light-permeable portion is positioned in alignment with said switch.

9. The switch device as set forth in claim 1, wherein said waterproof sheet is comprised of a flexible portion and an expandable portion.

10. The switch device as set forth in claim 9, wherein said expandable portion is in the form of bellows.

11. The switch device as set forth in claim 1, wherein a pattern indicative of where said switch is located is printed on said waterproof sheet.

12. The switch device as set forth in claim 1, further comprising an indicator indicative of whether said switch is turned on or off.

13. The switch device as set forth in claim 1, wherein the waterproof sheet has an area greater than the cross-sectional area of the recess by a predetermined percentage in the range of 15% to 50%.

14. The switch device as set forth in claim 1, wherein said waterproof sheet is adhered at its outer edge to a bottom of said wall within said recess.

15. The switch device as set forth in claim 1, wherein said switch is a toggle switch that has a portion extending towards an opening of said recess.

* * * * *